United States Patent [19]

Roberts

[11] 4,420,276

[45] Dec. 13, 1983

[54] BEARING ASSEMBLY FOR A TETHERED BUOYANT PLATFORM

[75] Inventor: Roy G. Roberts, Harrow, England

[73] Assignee: The British Petroleum Company Limited, London, England

[21] Appl. No.: 258,533

[22] Filed: Apr. 28, 1981

[30] Foreign Application Priority Data

Apr. 24, 1980 [GB] United Kingdom ..... 80/13564

[51] Int. Cl.[3] ..... E02D 5/54; B63B 21/50

[52] U.S. Cl. ..... 405/224; 114/265; 405/195

[58] Field of Search ..... 405/195–208, 405/224; 114/264, 265, 230; 175/5, 7; 441/3–5

[56] References Cited

U.S. PATENT DOCUMENTS

| | | | |
|---|---|---|---|
| 3,007,316 | 11/1961 | Higgins | 405/207 |
| 3,245,658 | 4/1966 | Sutton | 405/198 X |
| 3,517,517 | 6/1970 | Blenkarn . | |
| 3,563,042 | 2/1971 | Ryan | 114/265 X |
| 3,934,528 | 1/1976 | Horton et al. | 405/224 |
| 3,982,492 | 9/1976 | Steddum . | |
| 3,983,706 | 10/1976 | Kalinowski | 405/224 |
| 3,993,273 | 11/1976 | Dade . | |
| 3,996,755 | 12/1976 | Kalinowski . | |
| 4,226,555 | 10/1980 | Bourne et al. | 405/224 |
| 4,248,549 | 2/1981 | Czerewaty | 405/195 X |
| 4,351,258 | 9/1982 | Ray et al. | 114/265 X |

FOREIGN PATENT DOCUMENTS 1510425 5/1978 United Kingdom .

*Primary Examiner*—Dennis L. Taylor

*Attorney, Agent, or Firm*—Morgan, Finnegan, Pine, Foley & Lee

[57] ABSTRACT

A tether assembly (2) for a tethered buoyant platform for installation in a shaft (8) of a leg (10) of the tethered buoyant platform comproses a cable tether (4) having a terminal at one end for connecting to an anchor post (12) on the sea bed and having a bearing (16) which is a sliding fit in the shaft (8) of the leg (10) to transmit lateral forces from the tether to the shaft (8) of the platform. The assembly (2) further includes upper and lower bending guides (18 and 20) each providing a curved surface to control the bending radius of the tether (4) and a tether length adjuster (30) comprising a plurality of axially spaced apart members capable of engaging corresponding members associated with a releasable clamp (6).

8 Claims, 12 Drawing Figures

BEARING ASSEMBLY FOR A TETHERED BUOYANT PLATFORM

This invention relates to a tether assembly for a tethered buoyant platform and to a method of installing the tether assembly.

Tethered buoyant platforms, sometimes called tension leg platforms, have been previously proposed for the production of oil and/or gas at offshore locations. A tethered buoyant platform is a platform which, when in use, is moored vertically below its free floating position by means of tethers to which tension is applied.

By the word tethered in the present specification we do not intend to be limited to a platform the tethers of which are moored to the sea bed but to include a platform in a condition suitable for moving from one location to another.

Our Co-pending UK Patent Applications Nos. 25387/78 and 25388/78 describe respectively a tethered buoyant platform of novel construction and a tethering system therefor. The tethering system has now been improved by the development of an improved tether assembly for installation in the shaft of a leg of the tethered buoyant platform.

Thus according to the present invention, a tether assembly for a tethered buoyant platform suitable for installation in a shaft of a leg of the tethered buoyant platform, comprises a cable tether having a terminal at the end thereof for connecting to a corresponding member on the sea bed and having located at a position along it length a bearing to contact the sides of the shaft to transmit lateral forces from the tether to the shaft of the tethered buoyant platform.

The cable tether can have located at a position along its length a bending guide providing a curved surface to control the bending radius of the tether.

The bearing and the bearing guide can be provided by a member of generally cylindrical form adapted to be a sliding fit in the shaft of the leg and having an aperture extending lengthwise therethrough, the walls of the lower end of the aperture having the curved surface to control the bending radius of the tether.

The tether assembly can have a second bending guide located at a position along its length spaced apart from the first bending guide.

The cable can conveniently comprise a number of individual wires, for example, in helical form, although other forms of cable may be employed.

The tether assembly can include at a position along its length a tether length adjusting means, said means comprising a plurality of axially spaced apart members capable of engaging corresponding members associated with a releasable clamping means.

According to another aspect of the present invention a method of installing a tether assembly comprises locating a tether assembly as hereinbefore described in the shaft of a leg of a tethered buoyant platform connecting the lower end of the tether assembly to an anchor on the sea bed and subsequently applying tension to the tether assembly.

The invention is illustrated by reference to the accompanying drawings of which FIG. 1 is an elevation of a tether assembly located in the shaft of a leg of a tethered buoyant platform.

Figure 1:
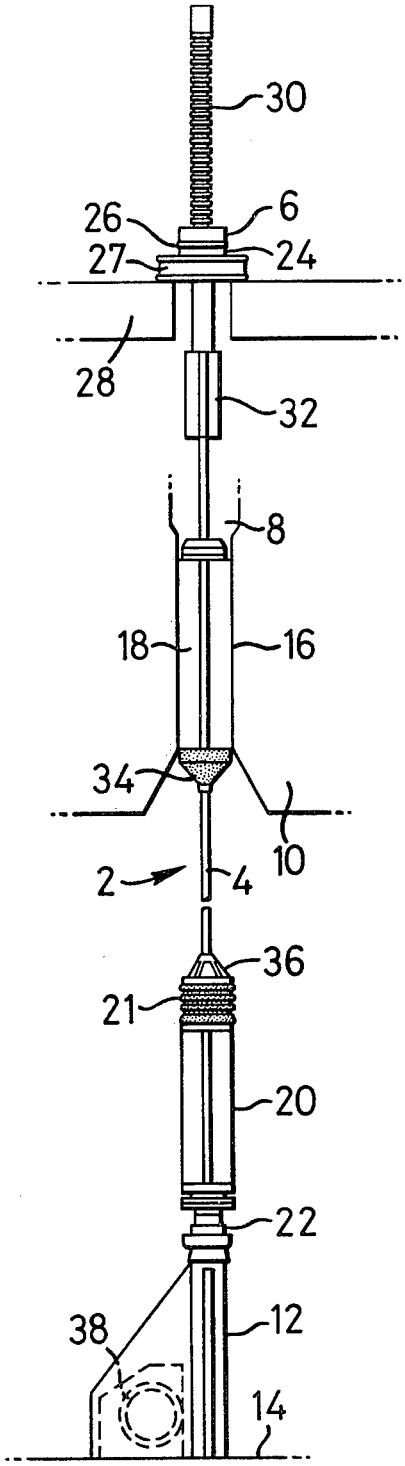

Referring to FIG. 1 the tether assembly indicated generally by numeral 2 comprises a wire rope tether 4 and extends through an upper termination clamp 6 on a tethered buoyant platform via a shaft 8 in a leg 10 of the platform to an anchor post 12 on an anchor base 14. An anchor connector 22 locks the lower end of the tether assembly 2 to the anchor post 12. The wire tether 4 itself extends from an adaptor casing 32 (shown in detail in FIG. 3) to a lower bending guide 20 (shown in detail in FIG. 7). The tether assembly 2 comprises a bearing 16 and upper bending guide 18 (shown in more detail in FIG. 6) located within the shaft 8 and in the region of the lower end thereof to accommodate the motion, fretting and bending that the platform imposes. A similar bending guide 20 having a rubber boot 21 (the bending guide being shown in more detail in FIG. 7) is located near the lower end of the tether assembly 2 adjacent to the anchor connector 22.

Located below the upper terminal clamp 6 is a load cell 24 and located therebetween are shims 26. Beneath the load cell 24 is a tether seat 27 which rests on a deck 28 of the tethered buoyant platform. Extending through the clamp 6 is a tether length adjustor 30. Below the deck 28 is the adaptor casing 32. At the lower end of the bending guide 18 is a rubber boot 34 and at the upper end of the lower bending guide 20 is a re-entry cone 36. Also shown is a haul down sheave 38 which is mounted on the anchor base 14.

Figure 11:
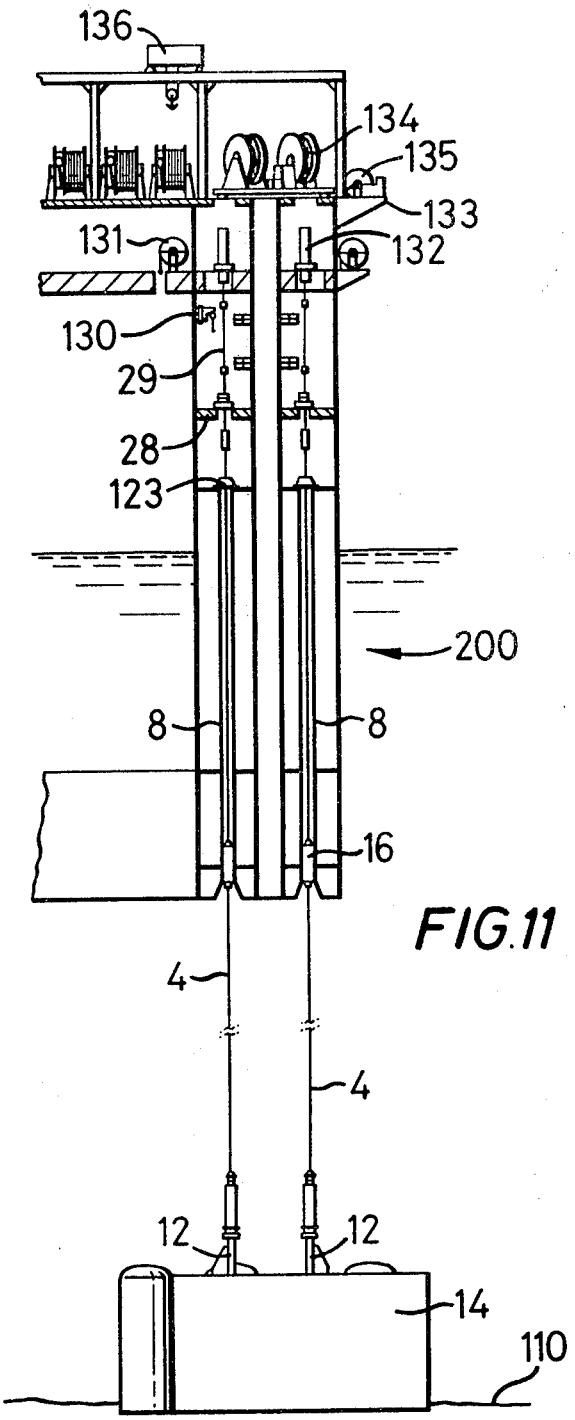
FIG. 11 is a vertical section showing the general arrangement of wire tethers and platform.
Figure 12:
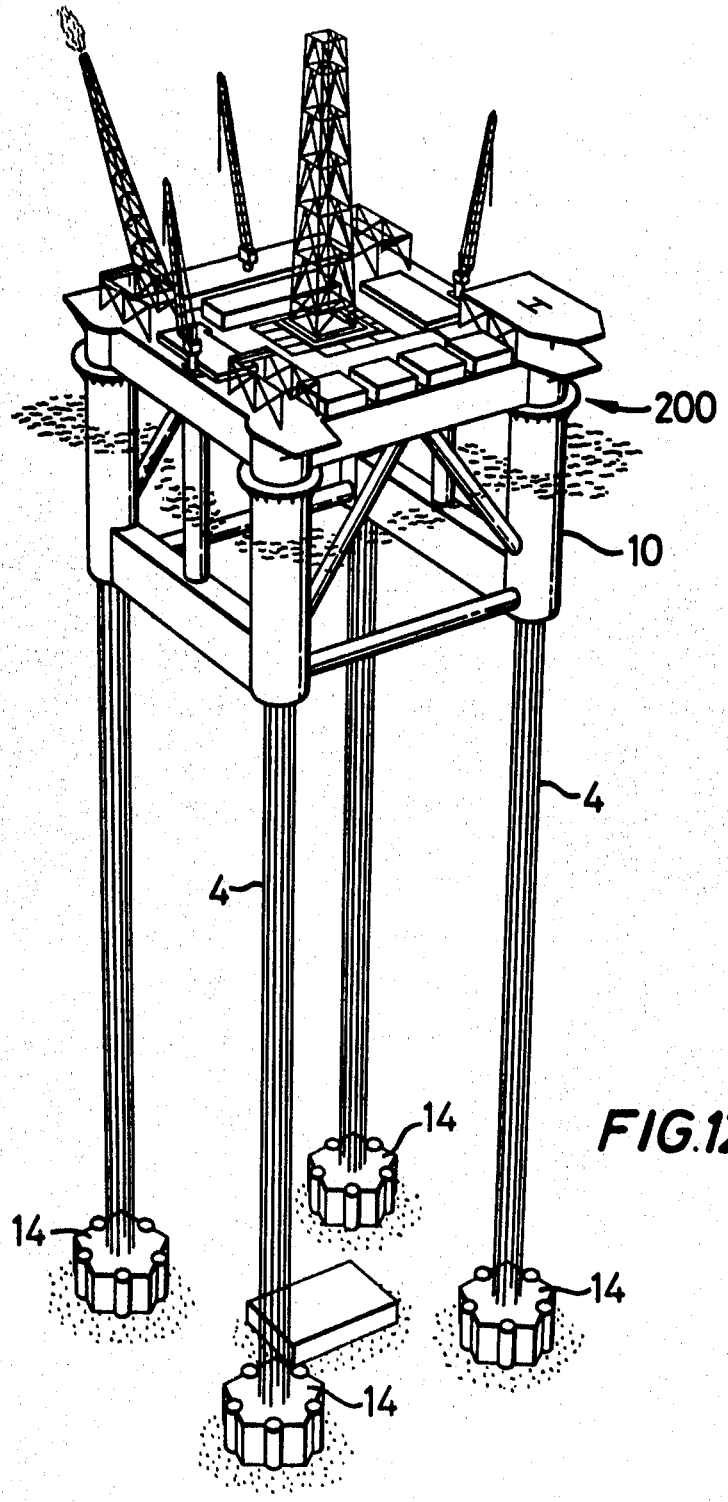
FIG. 12 is a perspective view of an installed tethered buoyant platform.

Referring to FIGS. 11 and 12 the tethered buoyant platform 200 is held on station by a system of vertical taut wire tethers 4 located at the four corners of the platform and secured to the sea bed 110 by four individual anchor bases 14 of either gravity or piled construction. There are eight tethers, four per leg 10 giving thirty two tethers in total. In each leg there are ten shafts, one for each tether plus two spares evenly spaced on an eight meter pitch circle diameter. There are ten corresponding anchor posts 12 on the anchor bases 14. Each tether is secured to an anchor post 12 and passes through its tether shaft 8 to emerge above the water line where it is secured to the tether anchorage deck 28. At the lower end of the tether shaft each tether passes through a bearing 16 where the horizontal component of the tether load is reacted as the tethered buoyant platform 200 moves under the influence of waves, wind and sea current.

During installation, each tether 4 is pulled onto its anchor post 12 by a haul down rope running from the tether 4 through the anchor post 12 and back to a haul down winch 131 on the platform. On each leg there are two completely independent sets of installation equipment to provide redundancy and so minimise the risk of being unable to run tethers 4 in each leg during the critical installation phase. A crane 130 is shown. Also shown is a catenary winch 135 used to handle the catenary moorings employed to maintain the platform on station during installation of the tethers.

The wire tether system components are shown in a general arrangement in FIG. 11. Each tether 4 has an anchor connector 22 which latches automatically to the anchor post 12 when it is pulled onto the post 12 by the haul down rope. A split bending guide 20 is bolted round the lower wire termination and fastened to the anchor connector 22. The bending guide 20 is trumpet shaped and controls the bend radius of the tether 4 when the platform 200 is offset. The tether 4 is a continuous steel wire spiral strand rope running from the lower bending guide 20 to the adaptor casing 32. At the lower end of the tether shaft 8 is a bearing 16 incorporating the upper bending guide which also controls the tether bend radius. The bearing 16 transmits the lateral tether forces to the tether shaft 8. The lower end of the shaft 8 is flared to allow re-entry of the tether components. The lower bending guide 20 has a re-entry cone fitted to the tether 4 just above the guide 20.

Figure 4:
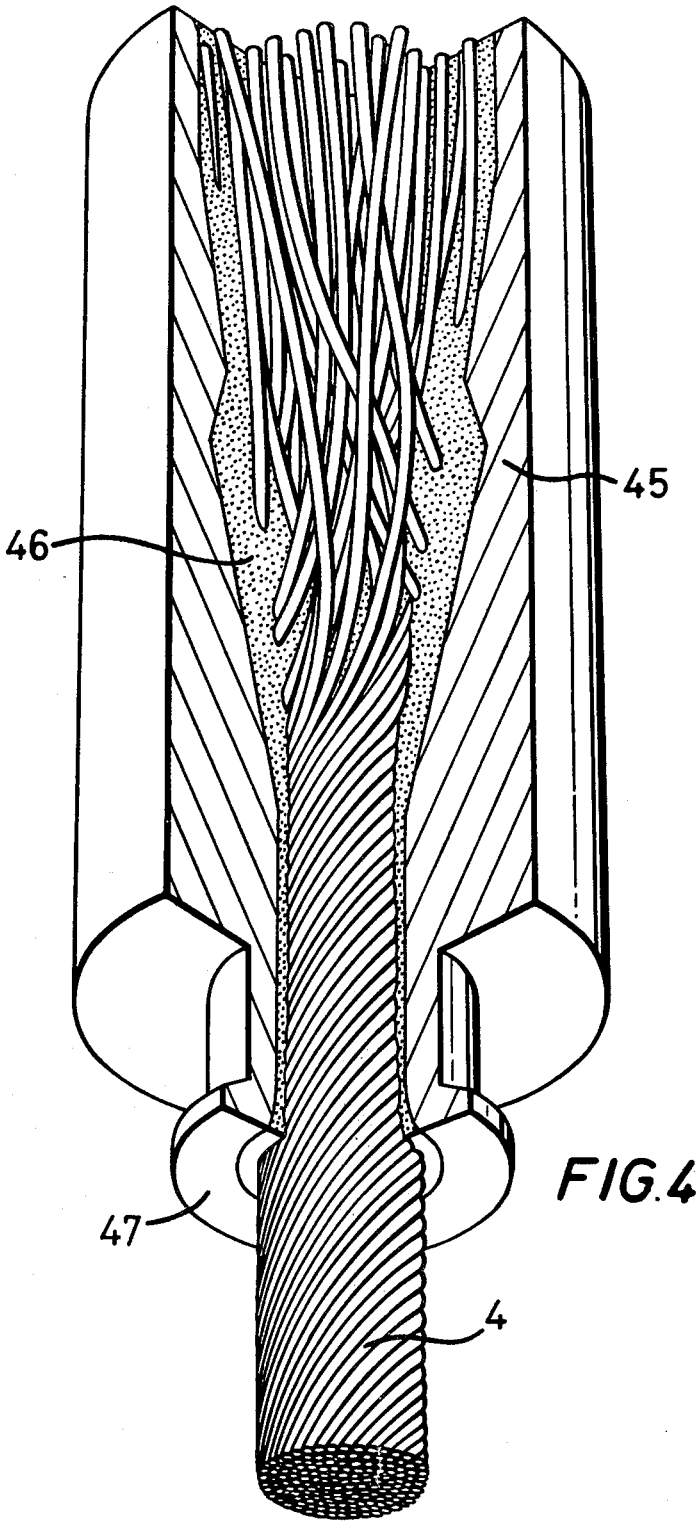
FIG. 4 is a perspective view of a wire tether termination also partly cut away.

Referring to FIG. 4 each tether assembly has a steel socket 45 at each end where the wire terminates in a collar of zinc or epoxy resin 46 to provide a cushioning medium. The upper socket 45 has a support foot 47 and is secured in an adjuster coupling that connects the tether 4 to the length adjuster 30 round which fits the upper termination clamp 6. The clamp sits on shims 26 and a load cell 24 on top of the seat 27 which transmits load to the tether anchorage deck 28.

In FIG. 11 there are two sets of installation equipment in each leg 10 to provide redundancy during the critical installation phase. The tether reels 134, eight per corner, are stored on the upper deck 133 and are moved onto the winch turntable by the gantry crane 136. Each reel becomes part of the tether winch of which there are two per leg mounted on the winch turntable. The tether assemblies 2 are run two at a time on each leg 10. The lower wire termination is lowered down the leg where it is fastened to the lower bending guide 20 and anchor connector 22 on the tether anchorage deck 28. A haul down rope runs from the anchor connector 22 down the tether shaft 8 through the anchor post 12 and back to a winch on the platform to position the anchor connector 22 over the post 12. The haul down ropes are installed using a submersible.

Each tether assembly has a tensioner 132 on the main deck connected to the length adjuster 30 by a make-up piece. The tensioner 132 lowers its tether assembly during the final installation stage when the tensioners for the first two tethers to be connected on each leg act as heave compensators. When the first two tether assemblies have been connected on each leg the heave compensation is shut down and the platform heave is controlled by these first tether assemblies while the remaining tether assemblies are connected to the anchor posts 12.

The tether assemblies 2 are tensioned by a combination of deballasting and use of the tensioners 132 to achieve the correct pre-tension to avoid going slack in storm conditions. Some installation equipment may be removed from the platform leaving sufficient for tether changeout.

The seat 27 (FIG. 1) consists of a square fabrication of box beams and a central hub cylinder joined by radial spokes to transfer the load from the hub to the frame.

Tensioner Make-up Piece

The tensioner make-up piece 29 (FIG. 11) forms an adjustable link between the tether 4 and the tensioner 132. The make-up piece has equally spaced transverse holes to take pins that secure it to the tether length adjuster 30 (FIG. 2) at the lower end and the tensioner 132 at the top. The lower end slides inside the tether length adjuster 30 and a hole in the make-up piece can be chosen to give the desired length between the tether length adjuster 30 and the tensioner 132.

Tether Long Life Wire

Figure 8:
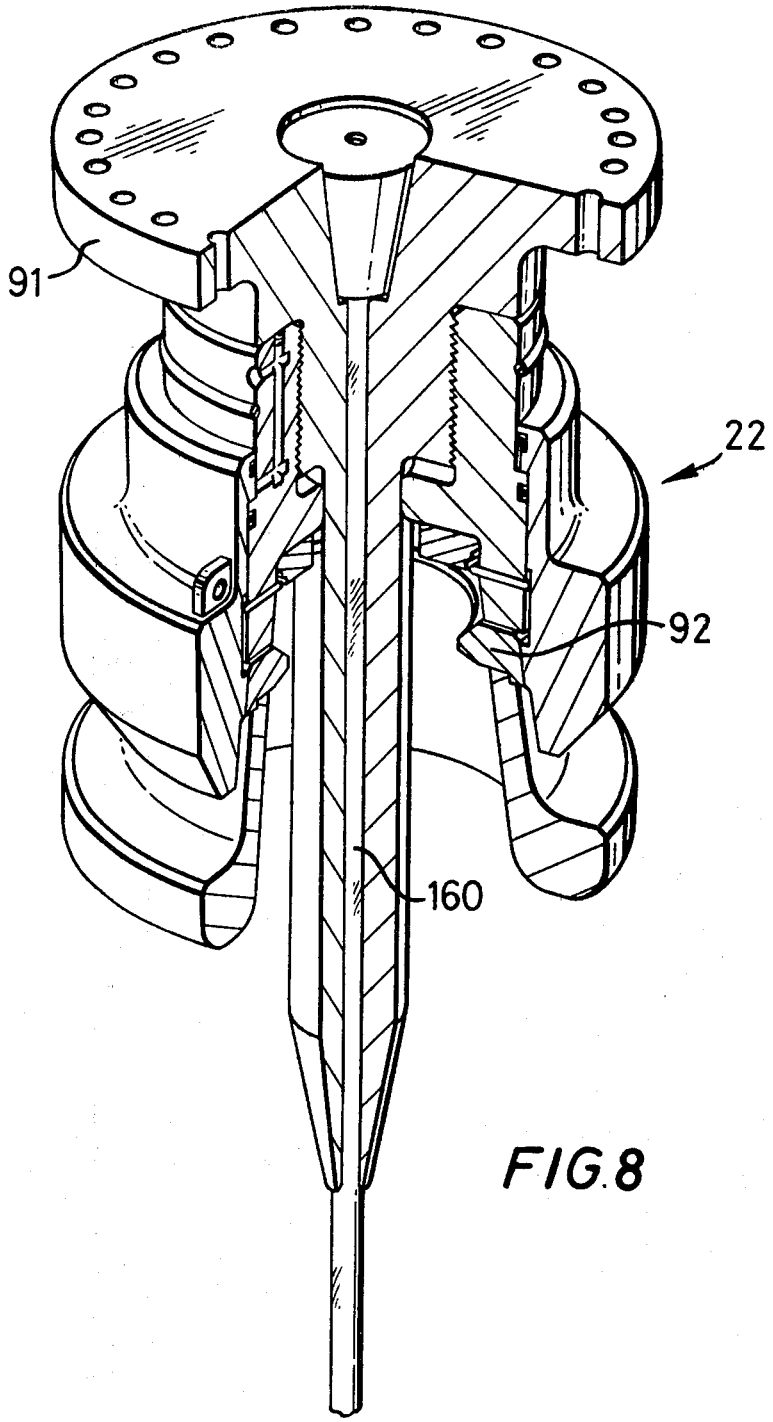
FIG. 8 is a perspective view of an anchor connector also partly cut away.

This is a short length of stainless steel wire 160 attached to the lower tether termination and emerging through the anchor connector 22 (FIG. 8).

It is attached to the haul down rope by a detachable coupling suitable for operation by a submersible. After the tether assembly 2 has been locked onto the sea bed anchor post 12 the long life wire is left passing through the anchor post 12 and its fairlead, emerging in a position accessible to the submersible ready for disconnection from the haul down rope proper. After disconnection, the long life wire remains in place until such time as a tether changeout takes place. In this event a submersible would be required to re-make the connection of the haul down rope and long life wire.

The long life wires are stowed in the tether anchorage deck 28 prior to installation.

Figure 10:
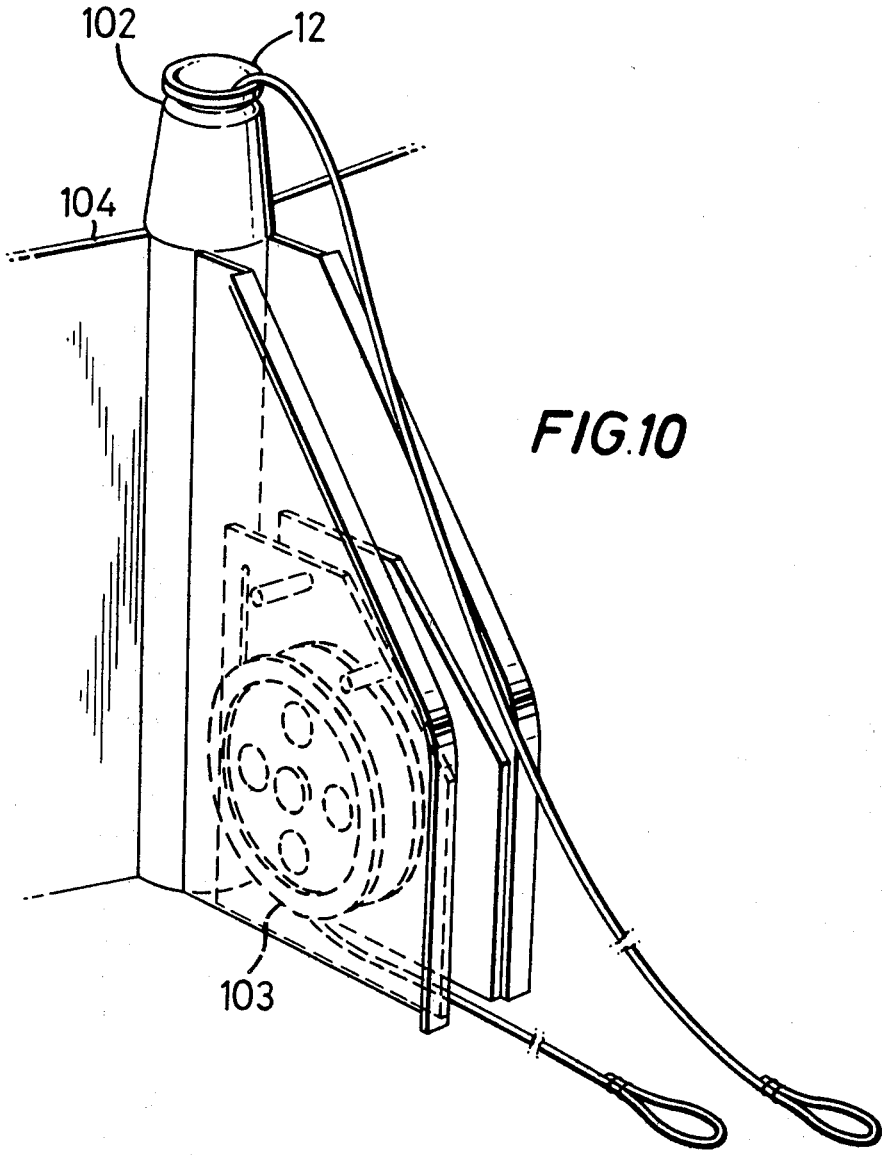
FIG. 10 is a perspective view of an anchor post and haul down sheave for the wire tethers.

Sea Based Long Life Wires (FIG. 10)

Further long life wires are installed one in each anchor post 12 before deployment on the sea bed. These are similar to the others but with identical couplings on both ends.

A submersible attaches the lower end of the first section of haul down rope to the end of the sea bed long life wire protruding from the anchor post. The second section of the haul down rope is connected to the other end of the sea bed long life wire in the same manner.

Haul Down Ropes

The haul down ropes are in three parts, and the total length is approximately equal to twice the depth of water.

They are made of 72 mm braidline nylon.

One section is installed for each tether before the platform is towed out to site. The remaining parts of the haul down ropes are stored on drums on the upper deck ready for connection and deployment by a work boat.

Tether Length Adjuster

Figure 2:
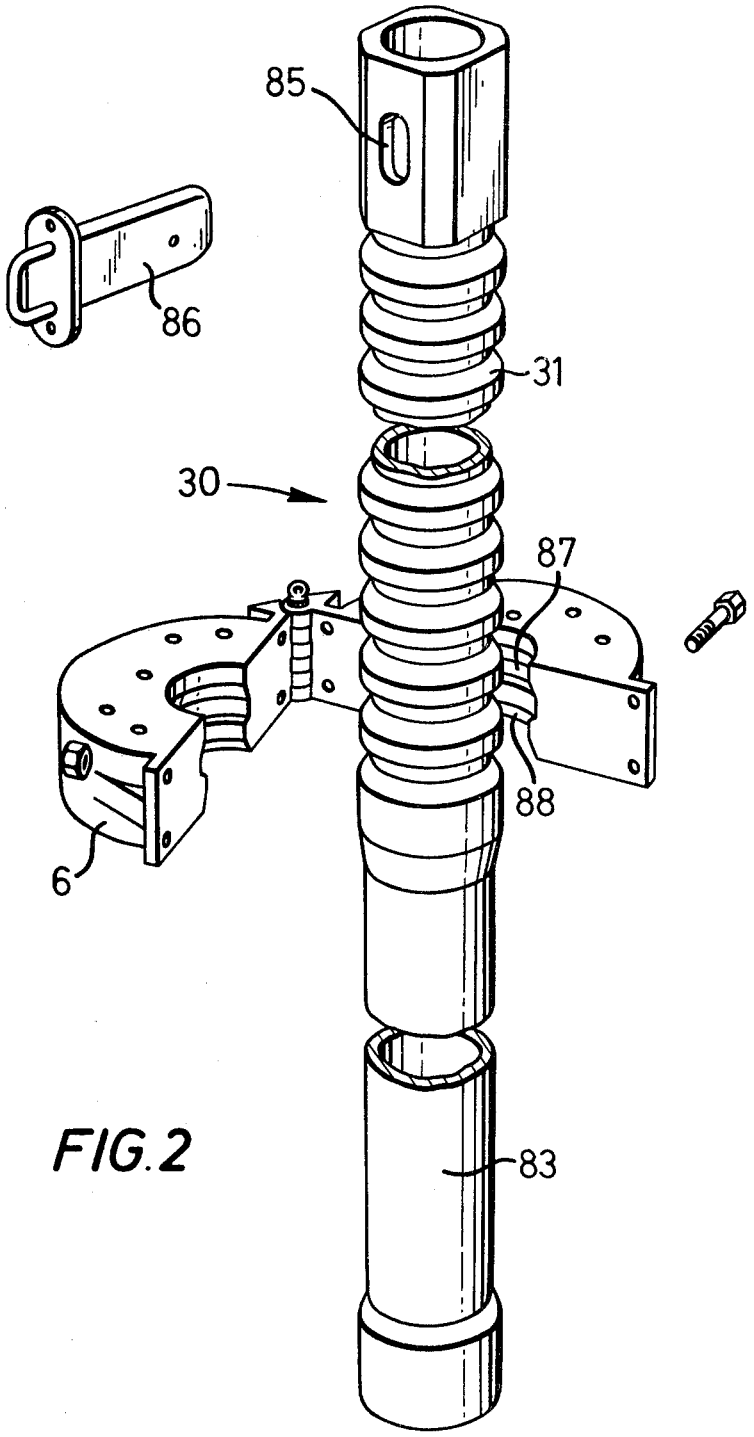
FIG. 2 is a perspective view of a tether length adjuster.

Referring to FIG. 2 this component is designed to provide a range of adjustment to cater for the following variables affecting the tether length:

Manufacturing tolerances on the wire tether.

Degree of accuracy in measuring the depth of water.

Tolerance of the platform draught.

Variation in water depth from one corner of the platform to another.

The tether length adjuster 30 is in thick walled steel tube 31 about seven meters long, with concentric grooves spaced evenly along part of its length in 150 mm increments. The upper termination clamp 6 bolts round the length adjuster 30 and grips in grooves sized to take the full tether load. The corners of the grooves 31 are radiused to resist fatigue cracking.

The lower end 83 is thickened to allow the adjuster 20 to be fastened to the wire tether 4 by the adaptor casing 32. At the upper end is a transverse hole 85 to accommodate a pin 86 that fastens the adjuster to the tensioner make-up piece 29 (FIG. 11). The make-up piece 29 is connected to the tensioner 132 to allow the tether tension to be hydraulically adjusted. The upper tether termination clamp 6 is positioned in the most suitable set of grooves and the tether is lowered onto the tether seat assembly which incorporates a split load cell 24 and shims. The tether load is recorded from the hydraulic pressure in the tensioner 132 and can be checked by the load cell 24 after the tether has been lowered into its seat 27.

Upper Termination Clamp

The upper termination clamp 6 is a steel ring split in two parts which are hinged to allow the clamp to be closed round the tether length adjuster 30. The two halves of the clamp 6 are securely bolted to give a rigid unit that transfers the tether load to the tether seat assembly. The clamp 6 has two circular spigots 87 and 88, 150 mm apart which locate in circumferential grooves 31 in the tether length adjuster 30. The upper spigot takes the load and the lower spigot has a 2 mm clearance and acts as a secondary load path in the unlikely event of failure of the upper spigot (or the tether length adjuster). The loads are transferred through the top surfaces of the upper spigot 87. A ring of nitrile rubber protrudes from the undersides of the spigots to ensure that the clamp ring is concentric with the tether length adjuster and to eliminate any axial backlash. All sharp corners are radiused to reduce the chance of fatigue cracking. The clamp ring is lightly bolted through the shims and load cell to the tether seat such that it secures the tether but yet avoids significant loading of the load cell 24.

Tension Adjusting Shims

These shims are located between the upper termination clamp 6 and the load cell 24. Each shim is a split steel ring to allow assembly round the tether tension adjuster.

For 450 m water depth the shims are 25 and 50 mm thick giving a minimum load adjustment of about 7.7 tonnes. For 200 m the shims are 12.5, 25 and 50 mm giving a minimum load adjustment of about 8.4 tonnes.

Load Cell

Load cells 24 provide continuous monitoring of individual tether loads giving maximum, mean and minimum loads. The load cell is an annular steel ring split in two parts to allow assembly round the tether tension adjuster. There are top and bottom plates between which is sandwiched the load measuring element. The element has strain gauges bonded to its surface and is coated to minimise the risk of damage. The Wheatstone bridge arrangements give an accurate measurement with temperature compensation provided by dummy gauges.

The load cell 24 sits on the tether seat 27 in the direct load path between the tether tension adjuster 132 and the seat 27. There are vertical holes to allow the securing bolts to pass from the upper termination clamp to the tether seat.

The gauges are linked to a central monitoring console with alarms that are tripped when maximum and minimum loads are approached and if the rate of change of mean load exceeds prescribed limits.

Except in bad weather conditions, the load cell readings may be checked by transferring the load from the tether seat to the hydraulic tensioner.

Tether Seat

The tether seat 27 is a fabricated component which transmits load from the tether to the tether anchorage deck during installation and operation. The radial slots in the seat allow it to be moved aside as the platform bearing is lowered through the anchorage deck, and each slot is closed by a loose section which is bolted into place to provide a continuous upper surface for the load cell. The seat is secured to the tether anchorage deck by bolts before the tether is tensioned. Holes in the upper surface of the seat enable the upper termination clamp, shims and load cell to be fastened to the seat with bolts.

Adaptor Casing

Figure 3:
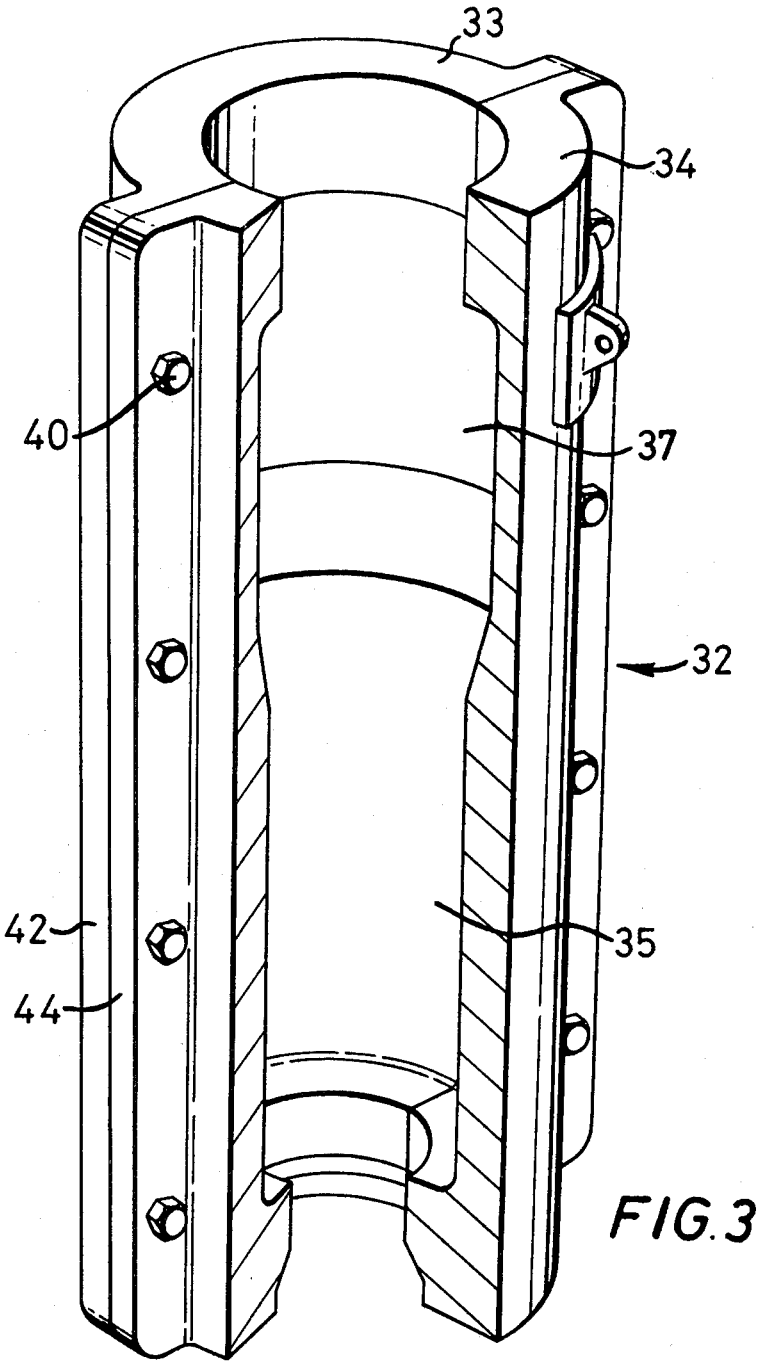
FIG. 3 is a perspective view of an adaptor casing partly cut away to show the internal construction.

Referring to FIG. 3 the adaptor casing indicated by numeral 32 houses the cable termination and joins the lower end of the tether length adjuster 30 to the upper end of the wire tether 4. The casing 32 is of a split cylindrical construction and is secured to the tether length adjuster 30 and tether 4 by bolts 40 through flanges 42 and 44 which secure the two halves 33 and 34 of the casing together. Recess 37 is provided for the end of the tether length adjuster and recess 35 for the end of the tether termination.

There is one adaptor casing for each tether and they are secured against the side of the platform leg adjacent to the tether to which they will be fitted.

Tether Shaft Sealing Cap 123

Figure 5:
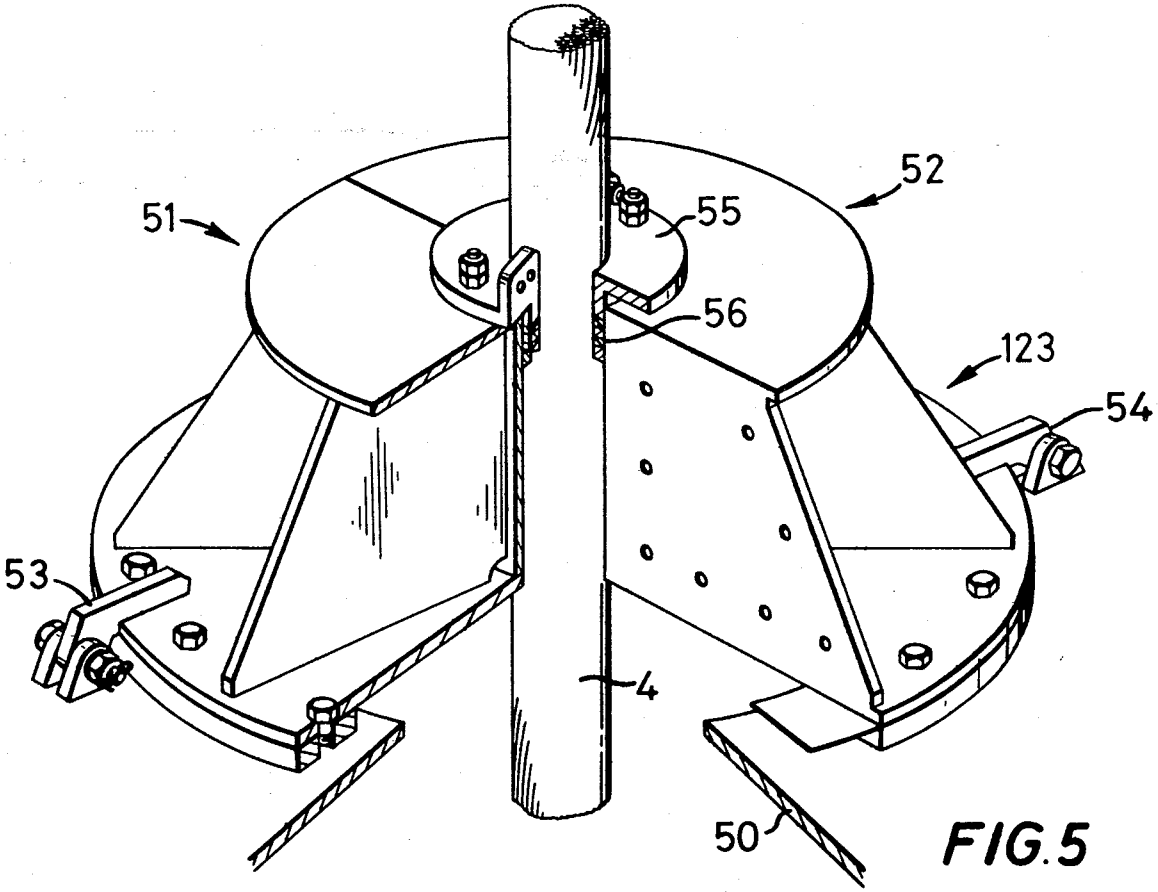
FIG. 5 is a perspective view of a sealing cap for a tether shaft also partly cut away.

Referring to FIG. 5 these components serve as watertight covers for the tether shafts 8 before and after tether installation and as a support platform for the tether assembly 2 whilst the tether length adjuster 30 is installed using the adaptor casings.

Each unit is two half caps 51 and 52 each hinged at 53 and 54 and opening in a direction away from the tether. A gland type seal 55 is fitted to the tether after installation and plain gaskets 56 are fitted to the joint between the two halves and the interface with the deck 50. A temporary cap is fitted to seal the tether aperture prior to tether installation.

Platform Bearing and Upper Bending Guide

Figure 6:
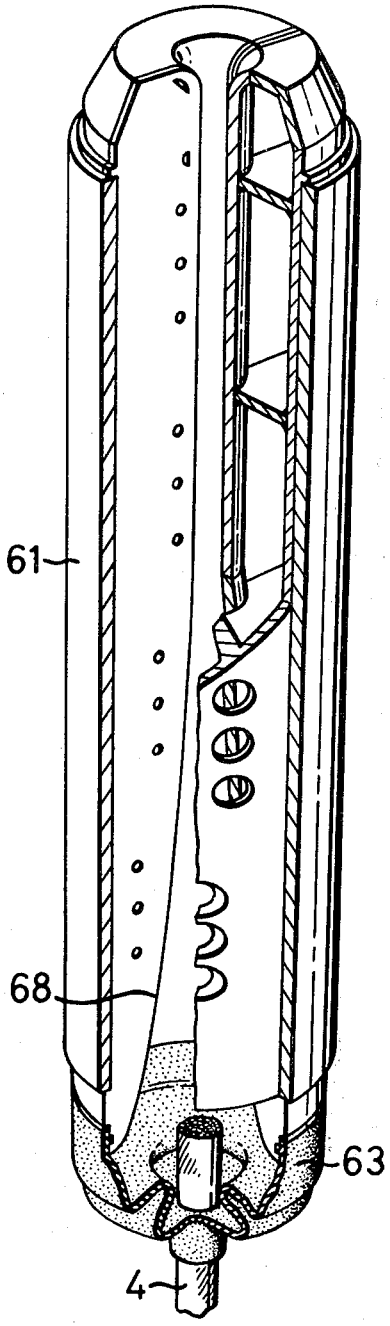
FIG. 6 is a perspective view of a bearing and upper bending guide also partly cut away.

Referring to FIG. 6 the platform bearing 18 transmits the restraining forces from the tether 4 to the platform 200 as the platform surges. The plain water lubricated bearing also allows differential movement to take place between the tether 4 and tether shaft 8 as the tether stretches under the influence of fluctuating loads.

The bearing 18 which is a sliding fit in the shaft 8 is in the form of a split cylinder 61 incorporating a bellmouth exit hole 68 at its lower end to control the bending radius of the wire tether 4 when the platform is offset.

The interior of the bearing and upper bending guide is filled with a corrision inhibiting oil.

The bearing material is a laminated plastic fibre material such as 'Railko' reinforced resin bearing material and is bonded to the outside of the cylinder 61. The bearing 18 is secured to the tether by friction when the two halves of cylinder 61 are bolted together around the tether 4.

Both halves of the unit are stored together on the tether anchorage deck, against the side of the platform leg adjacent to the tether to which it will be fitted.

Platform Bearing and Upper Bending Guide Rubber Boot

A rubber boot 63 is clamped onto the end of the bending guide and wire tether 4. Its function is to prevent the accumulation of marine growth in the bellmouth of the bending guide and retain the corrosion inhibiting fluid within it.

Lower Bending Guide 20

Figure 7:
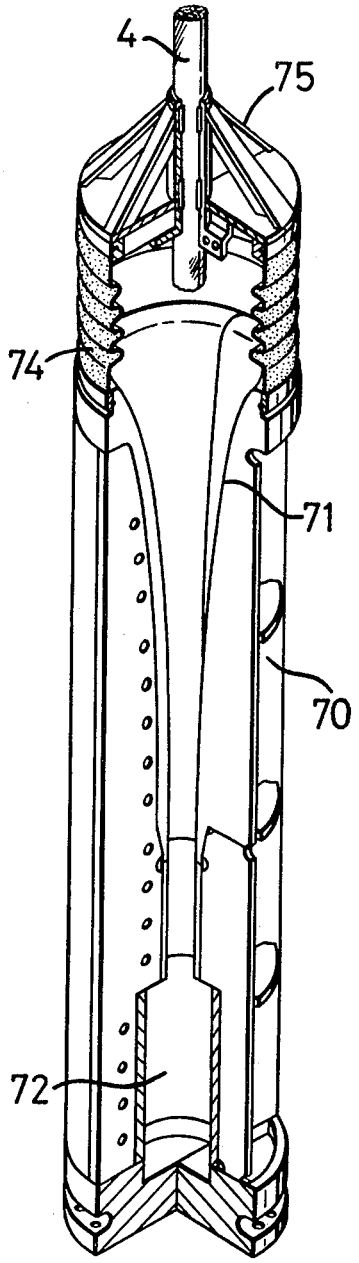
FIG. 7 is a perspective view of a lower bending guide also partly cut away.

Referring to FIG. 7 this item is also in the form of a split cylinder 70, the inside of which contains a socket 72 to retain the tether termination. Above this socket is a bellmouth exit hole 71 which serves as a bending guide for the wire tether 4 where it emerges from the unit.

The interior of the lower bending guide is filled with a corrosion inhibiting fluid retained by a rubber sealing boot 74 at the upper end.

One half of the lower bending guide is stowed already bolted to the anchor connector and the other half is stowed against the side of the platform leg adjacent to the tether on which it will be fitted.

Lower Bending Guide Rubber Boot 74 and Re-Entry Cone 75

A re-entry cone 75 is clamped to the tether 4 above the lower bending guide which ensures that the bending guide can be pulled into the tether shaft 8 in the platform leg during tether removal. A rubber boot is clamped to the cone 75 and the bending guide to avoid debris collecting in the guide, and to contain the lubricant/corrosion inhibitor with which the guide is filled.

Anchor Connector 22

Referring to FIG. 8 the anchor connector 22 is designed to latch automatically to the anchor post 12 when a tether is installed and then to transfer vertical and horizontal loads and bending movements from the tether 4 to the anchor post 12. The anchor connector 22 is pulled onto the anchor post 12 during installation and is therefore designed, as part of the pull-on system, with a flared mating skirt 161 and a central alignment probe 162.

The automatic latching system is actuated by contact between the connector 22 and the anchor post 12 at which point a weight is released on the connector which drives a set of dogs 92 into a groove 102 on the anchor post 12. The weight is then locked in place. The mating faces on the connector and anchor post are tapered to allow for misalignment during installation or removal. In order to remove the connector the weight holding the dogs 92 in place is unlocked and raised hydraulically and the connector 22 is pulled from the anchor post 12.

A flange 91 on the top of the connector mates with a flange on the lower bending guide. The long life wire of the tether haul down system passes through the anchor connector and is terminated in the anchor connector flange where it is held in position by the base of the lower bending guide.

Anchor Post

Referring to FIG. 10 the anchor posts 12 are thick walled hollow steel tubes 4 meters high and 610 mm outside diameter. The ten anchor posts 12 are evenly spaced on an 8 meter diameter pitch circle and the lower end of each post is built into the anchorage unit 14. The upper end is tapered to receive the anchor connector and there is a circular groove in the tapered section to accept the dogs of the anchor connector. The top of the post 12 is radiused both externally and internally to assist in tether connection and to minimise wear on the haul down rope as it passes through the top of the post and out through a vertical slot in the side of the post.

The anchor post 12 will have a temporary debris lid fitted prior to anchorage installation and removed prior to tether installation.

Haul Down Sheave

Each anchor post has a haul down sheave 103 positioned outside the ring of anchor posts between the two outer bracing webs 104. The unit is connected to the anchor post bracing webs by two pins which may be withdrawn if removal of the fairlead is necessary.

The haul down sheave 103 transmits the tether haul down forces from the haul down ropes to the anchorage unit 14.

Tether Winch Turntable

Figure 9:
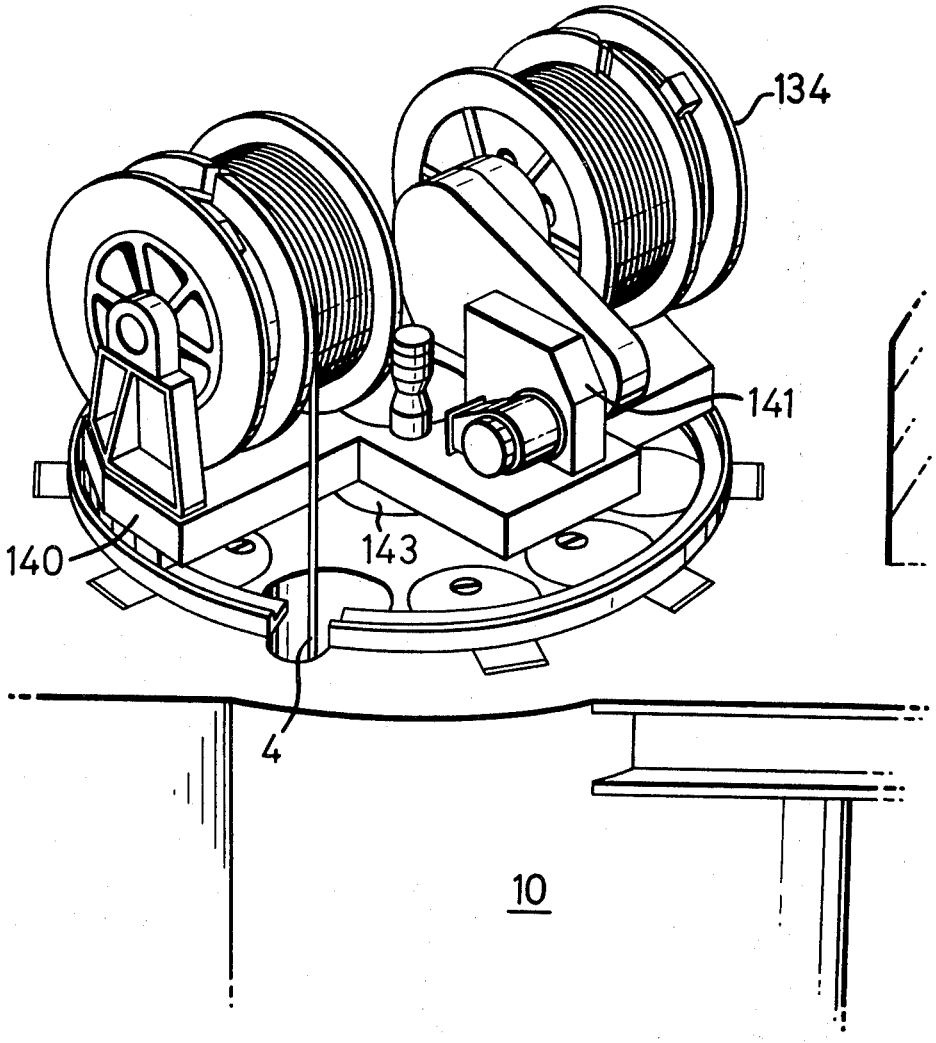
FIG. 9 is a perspective view of the winches for the wire tethers.

Referring to FIG. 9 there are four tether winch turntable packages, one for each platform leg, which are used to raise and lower the wire tether assemblies during initial installation and changeout as required. The packages consist of the following elements:

Turntables 140

This unit carries two electric winch units diametrically opposed, and is mounted on a slewing ring around the central column of the platform leg. The turntable 140 is slewed by electric motors 141, two in number, and has a facility for either of the two winches to index over any one of the tether shafts and lock in position.

A $2\frac{1}{2}$ meter diameter access hole 143 into the central column of the platform leg is located in the centre of the turntable.

Winches

Each winch is made up of a drive stand and removable interchangeable reels 134 on which are wound the wire tethers and tail ropes. When a wire tether 4 has been fully lowered and temporarily seated onto the tether shaft sealing cap the tail rope is wound back onto the reel where it remains. The reel is then lifted from the drive stand and transferred to the stowage area by the gantry crane, a further full reel being taken from the stowage area and loaded onto the drive stand. The reel 134 is both a supply package and a working part of the winch. There are nine such reels for each platform leg, one of which is spare. Seven of the reels are stowed on the stowage area within the area served by the gantry crane. In this area are eight stowage points, one of which is always empty.

I claim:

1. A tether assembly for a tethered buoyant platform, suitable for installation in a shaft of a leg of the tethered buoyant platform, comprising a cable tether having a terminal at the end thereof for connecting to a corresponding member on the sea bed and having located at a position along its length (a) a bearing to contact the sides of the shaft to transmit lateral forces from the tether to the shaft of the tethered buoyant platform and (b) a bending guide, the bearing and the bending guide being provided by a member of generally cylindrical form adapted to be a sliding fit in the shaft of the leg and having an aperture extending lengthwise therethrough, the wall of the lower end of the aperture having a curved surface to control the bending radius of the tether.

2. A tether assembly as claimed in claim 1 wherein the interior of the member of cylindrical form contains a corrosion inhibiting fluid.

3. A tether assembly as claimed in claim 1 wherein a second bending guide is provided, the second bending guide being spaced apart from the first bending guide.

4. A tether assembly as claimed in claim 1 wherein the tether assembly further includes a tether length adjuster comprising a plurality of axially spaced apart members capable of engaging corresponding members associated with a releasable clamp.

5. A tether assembly as claimed in claim 4 wherein the releasable clamp is located above a seat which transmits load to a deck of the platform.

6. A tether assembly as claimed in claim 5 wherein a load cell is located between the seat and the releasable clamp.

7. A tether assembly as claimed in claim 4 wherein the tether shaft has a sealing cap to prevent entry of water and provide support for the tether during installation of the tether length adjuster.

8. A tether assembly as claimed claim 1 wherein at least one end of the cable tether terminates in a cushioning medium enclosed in a housing.

* * * * *